US009365321B2

(12) United States Patent
Wu

(10) Patent No.: US 9,365,321 B2
(45) Date of Patent: Jun. 14, 2016

(54) VERSATILE STORAGE BIN STRUCTURE

(71) Applicant: Shuter Enterprise Co., Ltd., Taichung (TW)

(72) Inventor: Yira Wu, Taichung (TW)

(73) Assignee: Shuter Enterprise Co., Ltd., Taichung (TW)

( * ) Notice: Subject to any disclaimer, the term of this patent is extended or adjusted under 35 U.S.C. 154(b) by 52 days.

(21) Appl. No.: 14/183,569

(22) Filed: Feb. 19, 2014

(65) Prior Publication Data

US 2015/0232238 A1 Aug. 20, 2015

(51) Int. Cl.
*B65D 25/38* (2006.01)
*B65D 21/02* (2006.01)

(52) U.S. Cl.
CPC ..... *B65D 25/38* (2013.01); *B65D 21/0219* (2013.01)

(58) Field of Classification Search
CPC ..... B65D 21/0233; B65D 25/005; B65D 43/0206; B65D 43/22; B65D 43/24; B65D 43/26; B65D 88/129; B65D 88/522; B65D 88/524; B65D 90/0086; B65D 90/021; B65D 2519/00034; B65D 2519/00069; B65D 2519/00174; E06B 3/5045; E06B 3/385; A47B 43/00; A47B 46/005; A47B 77/18; A47B 87/02; A47B 87/0215; A47B 87/0284; A47B 88/0477; A47B 96/04; E05D 3/14; E05D 3/142; E05D 13/1207; E05D 15/42; E05D 15/58; E05D 15/582; G11B 33/02; B65F 1/1623; B65F 1/163
USPC ..... 206/501, 503, 508, 509; 220/1.5, 6, 7, 220/23.6, 254.1, 263, 608, 812–813, 817, 220/908; 280/33.991, 33.992, 79.2; 312/109, 139.1, 319.1–319.2, 312/322–323, 326–329, 332–334.1, 334.11, 312/350; 16/362, 364; 49/254, 258, 260
See application file for complete search history.

(56) References Cited

U.S. PATENT DOCUMENTS

| | | | | | |
|---|---|---|---|---|---|
| 640,078 | A | * | 12/1899 | Baker | 312/107 |
| 1,577,445 | A | * | 3/1926 | Bremken | 312/290 |
| 4,760,921 | A | * | 8/1988 | Licari | 206/504 |
| 5,040,834 | A | * | 8/1991 | Kahl et al. | 292/204 |
| 5,190,156 | A | * | 3/1993 | Conaway et al. | 206/509 |
| 5,507,385 | A | * | 4/1996 | Koloski et al. | 206/372 |
| D372,673 | S | * | 8/1996 | Turner | D3/302 |
| 5,564,805 | A | * | 10/1996 | Dickinson | 312/249.8 |
| 6,062,416 | A | * | 5/2000 | Smillie | 220/524 |
| 6,202,922 | B1 | * | 3/2001 | Phillips et al. | 220/908 |
| 7,350,789 | B2 | * | 4/2008 | Uffner et al. | 206/503 |
| D719,731 | S | * | 12/2014 | Burgess et al. | D3/302 |

(Continued)

*Primary Examiner* — Bryon Gehman
*Assistant Examiner* — Brijesh V. Patel
(74) *Attorney, Agent, or Firm* — Alan D. Kamrath; Kamrath IP Lawfirm, P.A.

(57) ABSTRACT

A versatile storage bin structure includes a storage bin body. A receiving space, an upper opening coverable with an upper lid, and a lateral opening coverable with a right lateral lid are disposed at the storage bin body. A long groove is disposed beneath the lateral opening and communicates with a bottom space of the storage bin body. The bottom space has therein two rail grooves. Two tenons are disposed at two ends of the bottom edge of the right lateral lid, respectively, and inserted into the space defined by the rail grooves and the long groove. The right lateral lid can be pushed into the long groove for concealment. The first and second fasteners are disposed at the right lateral lid and the left lateral face, respectively, to fasten the upper lid. A frame-like rib is disposed on the upper lid to stack and elevate the storage bins.

7 Claims, 8 Drawing Sheets

(56) References Cited

U.S. PATENT DOCUMENTS

2004/0100171 A1* 5/2004 Brown ..... 312/322
2004/0239216 A1* 12/2004 Castillo ..... 312/322
2008/0218043 A1* 9/2008 Gianelo ..... 312/319.2
2008/0308447 A1* 12/2008 Boland ..... 206/512
2009/0050508 A1* 2/2009 Van Ness ..... 206/515
2010/0006467 A1* 1/2010 Joseph et al. ..... 206/508
2010/0072100 A1* 3/2010 Henry et al. ..... 206/459.5
2012/0199513 A1* 8/2012 Wagner ..... 206/505

* cited by examiner

VERSATILE STORAGE BIN STRUCTURE

BACKGROUND OF THE INVENTION

1. Technical Field

The present invention relates to the technical field of storage bins and, more particularly, to a versatile storage bin structure which comprises a storage bin body with upper and lateral openings coverable by an upper lid and a right lateral lid, respectively. The right lateral lid can be opened downward and then pushed below the storage bin body for concealment, such that articles can be taken from and put in the storage bin from above or from the side of the storage bin, thereby featuring enhanced ease of use.

2. Description of Related Art

Due to the diversity of articles and the timing of their usage, people usually store unused articles according to type and by means of storage bins. There are two categories of conventional storage bins. In the first category, a conventional storage bin essentially comprises a box with an upper opening coverable by an upper lid, and two fasteners for fastening the upper lid after the upper lid has been shut. Although articles can be stored conveniently in the box of the conventional storage bin, it is quite difficult to take articles out of the lower ones of the boxes stacked up. Before taking articles out of the lower boxes, a user has to remove the upper boxes, open their fasteners, and lift their upper lids, one by one.

Another conventional storage bin is drawer-like. Although it is convenient to stack up the drawer-like storage bins and easy to take/put articles from/into the stacked drawer-like storage bins, the convenient drawer-like storage bin has drawbacks as follows: it comprises a box and a drawer which are manufactured separately, thereby resulting in a waste of materials; and, only the first half of the receiving space of the drawer-like storage bin is easy to see and access, because articles positioned proximate to the opening of the drawer are easy to take or put when the drawer is opened, but it is rather difficult to access the rear portion of the space inside the drawer and take/put articles from/into the rear portion of the space inside the drawer.

SUMMARY OF THE INVENTION

It is an objective of the present invention to provide a versatile storage bin structure with a storage bin body having upper and lateral openings coverable by an upper lid and a right lateral lid, respectively. The right lateral lid can be opened downward and then pushed below the storage bin body for concealment, such that articles can be taken from and put in the storage bin from above or from the side of the storage bin, thereby featuring enhanced ease of use.

In order to achieve the above and other objectives, the present invention provides a versatile storage bin structure comprising a storage bin body. A receiving space, an upper opening, and a lateral opening are disposed at the storage bin body, and a long groove is disposed beneath the lateral opening of the storage bin body and communicates with a bottom space of the storage bin body. The bottom space has therein two rail grooves, such that the upper opening of the storage bin body is covered precisely with an upper lid, and the lateral opening is covered precisely with a right lateral lid. The storage bin operates in either of the two modes as follows: stack cabinets and a single storage box. Two tenons are disposed protrudingly at two ends of the bottom edge of the right lateral lid, respectively, and inserted into the space defined and enclosed by the two rail grooves and the long groove, respectively. The right lateral lid can be shut or opened and thus pushed into the long groove for concealment. The first and second fasteners are disposed at the top portions of the right lateral lid and the left lateral face, respectively, to fasten the upper lid in place. A frame-like rib is disposed on the top side of the upper lid and adapted to firmly stack and elevate the storage bins, thereby facilitating the operation of the first and second fasteners.

The present invention provides a versatile storage bin structure with a lateral lid which can be opened fully until it comes close to the bottom of a storage bin body of the versatile storage bin structure and gets fastened to the bottom of the storage bin body, such that the lateral lid can be positioned in diverse ways.

DETAILED DESCRIPTION OF THE EMBODIMENT OF THE INVENTION

Figure 1:
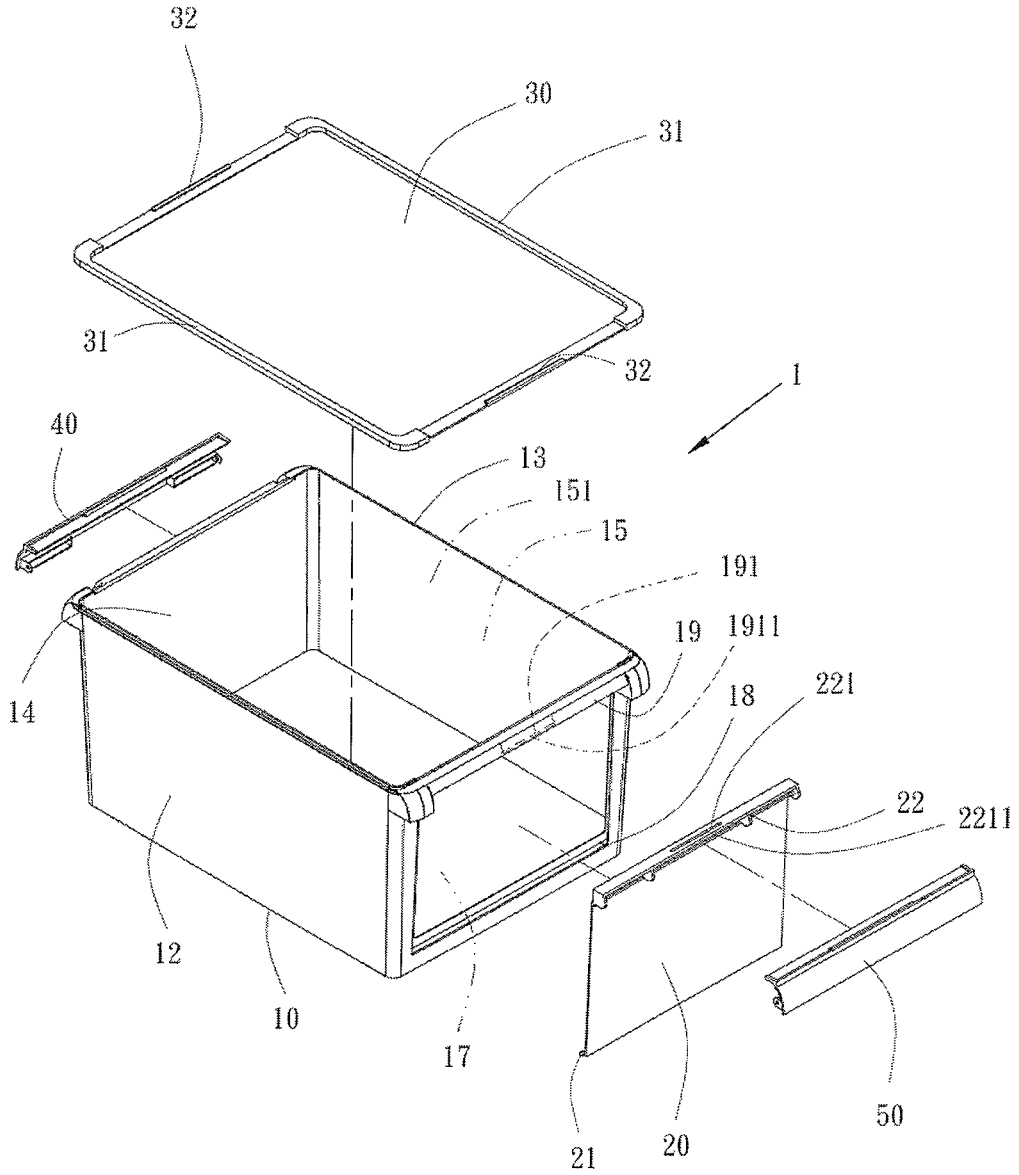
FIG. 1 is an exploded view of a versatile storage bin structure according to an embodiment of the present invention.
Figure 2:
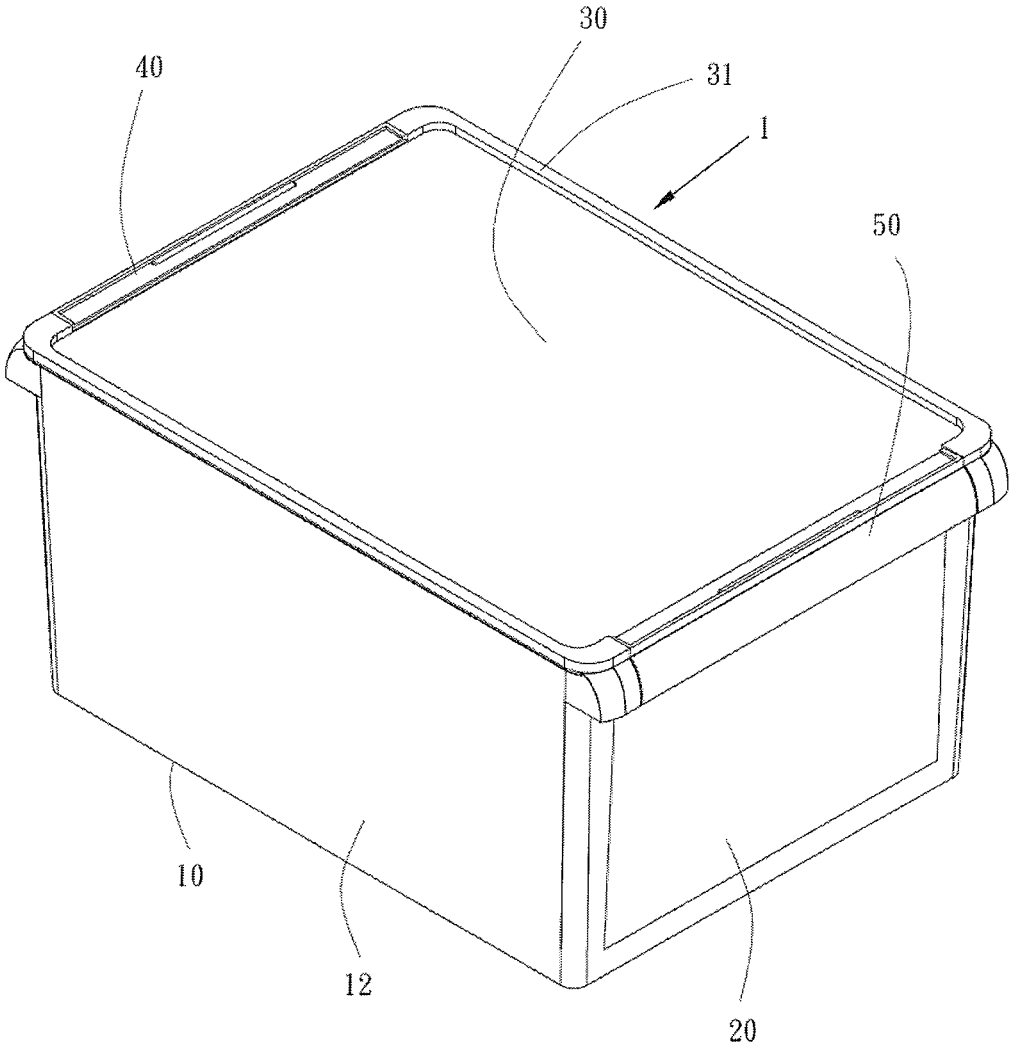
FIG. 2 is a perspective view of the versatile storage bin structure according to an embodiment of the present invention.
Figure 3:
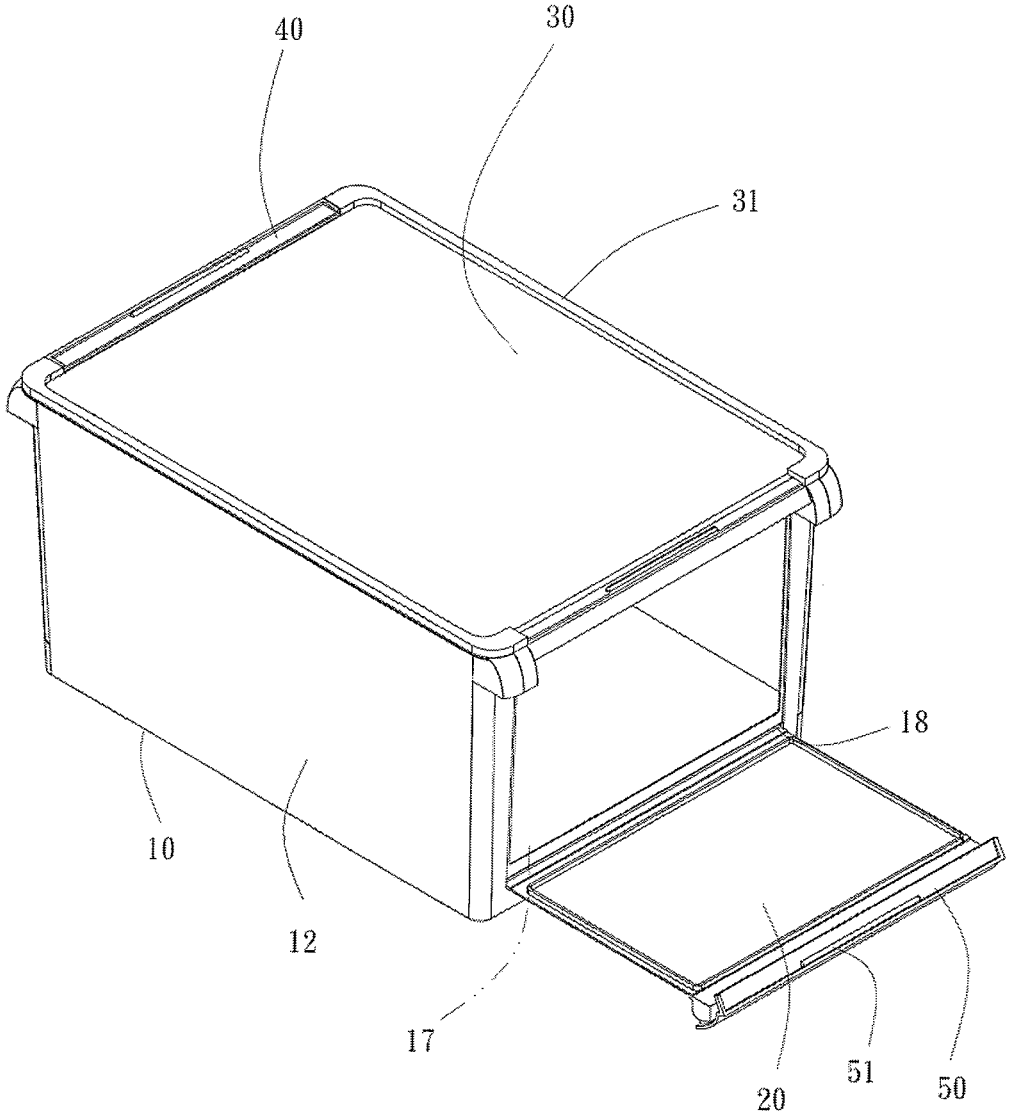
FIG. 3 is a perspective view of the versatile storage bin structure with a right lateral lid opened downward to expose a lateral opening according to an embodiment of the present invention.
Figure 4:
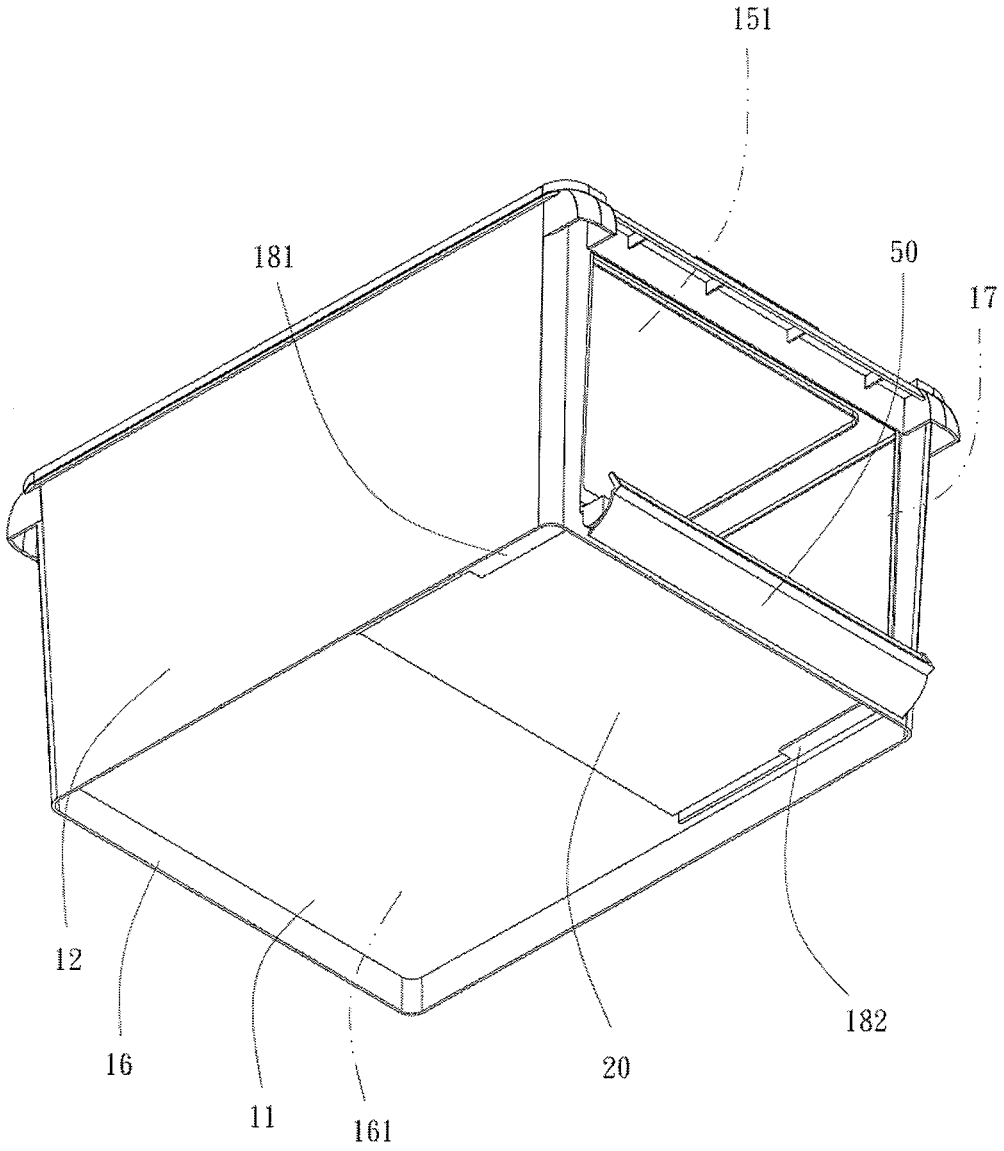
FIG. 4 is a bottom perspective view of the versatile storage bin structure according to an embodiment of the present invention.
Figure 5:
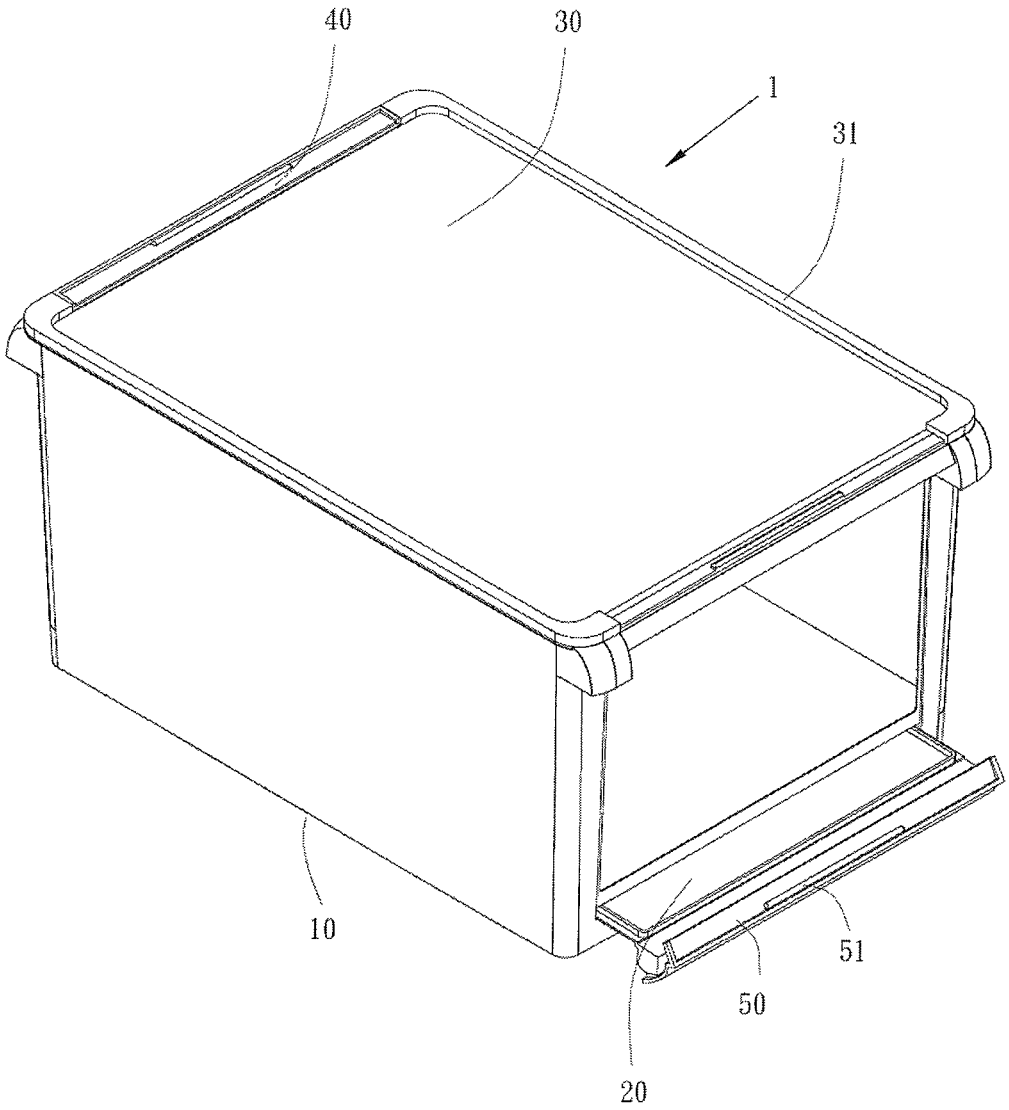
FIG. 5 is a schematic perspective view of the versatile storage bin structure with the right lateral lid pushed halfway into a long groove according to an embodiment of the present invention.

The present invention provides a versatile storage bin structure.

Referring to FIG. 1 through FIG. 8, the present invention provides a versatile storage bin structure which essentially comprises a storage bin body 10.

The storage bin body 10 has a bottom face 11, a front lateral face 12, a rear lateral face 13, and a left lateral face 14. The bottom face 11, the front lateral face 12, the rear lateral face 13 and the left lateral face 14 together define and enclose a receiving space 15 which has an upper opening 151. The periphery of the bottom face 11 extends downward to form a flange 16 running along the periphery fully. The flange 16 defines and encloses a bottom space 161 which opens downward. The storage bin body 10 is characterized by essential technical features described below.

The storage bin body 10 is provided rightward with a lateral opening 17. The lateral opening 17 is coverable precisely by a right lateral lid 20. A long groove 18 is disposed at a right portion of the flange 16 of the storage bin body 10. The long groove 18 is in communication with the bottom space 161. The long groove 18 extends in the direction of the bottom space 161 to form two rail grooves 181, 182 disposed on the bottom face 11 of the storage bin body 10. The distance between the two rail grooves 181, 182 is slightly larger than the length of the long groove 18. Two tenons 21 are disposed protrudingly at two ends of the bottom edge of the right lateral lid 20, respectively. The width of the right lateral lid 20 equals the length of the long groove 18. The two tenons 21 are inserted and confined to the space defined and enclosed by the two rail grooves 181, 182 in the long groove 18, respectively. Hence, with the two tenons 21 each functioning as an axis, the right lateral lid 20 by which the lateral opening 17 is coverable can be rotated about the two tenons 21 to be opened or shut. When opened to lie horizontally, the right lateral lid 20 can be pushed to slide the two tenons 21 relative to the two rail grooves 181, 182, respectively, such that the right lateral lid 20 retreats into the bottom space 161 of the storage bin body 10. A raised portion 22 wider than the long groove 18 is disposed at the top portion of the right lateral lid 20 and adapted to restrict the limit of the retreat of the right lateral lid 20. A projecting edge portion 19 is disposed at the upper edge of the lateral opening 17 of the storage bin body 10. The right lateral lid 20 can cover the lateral opening 17 fully and allows the raised portion 22 to come close to the projecting edge portion 19. A male engaging element 221 is disposed on the raised portion 22. A female engaging slot 191 corresponding in position to the male engaging element 221 is disposed on the projecting edge portion 19. Hence, when the lateral opening 17 is covered with the right lateral lid 20, the male engaging element 221 is engaged with and thus fastened to the female engaging slot 191.

Regarding the versatile storage bin structure, the male engaging element 221 of the raised portion 22 of the right lateral lid 20 comes in the form of a rib 2211 or a plurality of round bumps. The female engaging slot 191 of the storage bin body 10, which corresponds in position to the rib 2211 or the plurality of round bumps of the right lateral lid 20, has a recess 1911. When the lateral opening 17 of the storage bin body 10 is covered with the right lateral lid 20, the rib 2211 or the plurality of round bumps is engaged with and thus fastened to the recess 1911 of the storage bin body 10 to not only allow the right lateral lid 20 to be fixed in place but also allow the right lateral lids 20 to be smoothly opened or shut even when the storage bin bodies 10 are stacked up.

Regarding the versatile storage bin structure, the storage bin body 10 further comprises an upper lid 30 which covers the upper opening 151 of the storage bin body 10 precisely.

Regarding the versatile storage bin structure, the storage bin body 10 further comprises a first fastener 40 disposed pivotally at the top portion of the left lateral face 14 of the storage bin body 10. When rotated and lifted, the first fastener 40 engages with and presses against the upper lid 30 and the storage bin body 10 to thereby couple the storage bin body 10 and the upper lid 30 together.

Regarding the versatile storage bin structure, the right lateral lid 20 further comprises a second fastener 50 disposed pivotally at the raised portion 22 at the top portion of the right lateral lid 20. When rotated and lifted, the second fastener 50 engages with and presses against the upper lid 30 and the storage bin body 10 to thereby couple the storage bin body 10 and the upper lid 30 together.

A frame-like rib 31 is disposed on the top side of the upper lid 30 of the versatile storage bin structure. When the storage bin bodies 10 are stacked up, the frame-like rib 31 not only fastens but also elevates the storage bin body 10 above, such that the first and second fasteners 40, 50 can still be smoothly disengaged or engaged.

Figure 6:
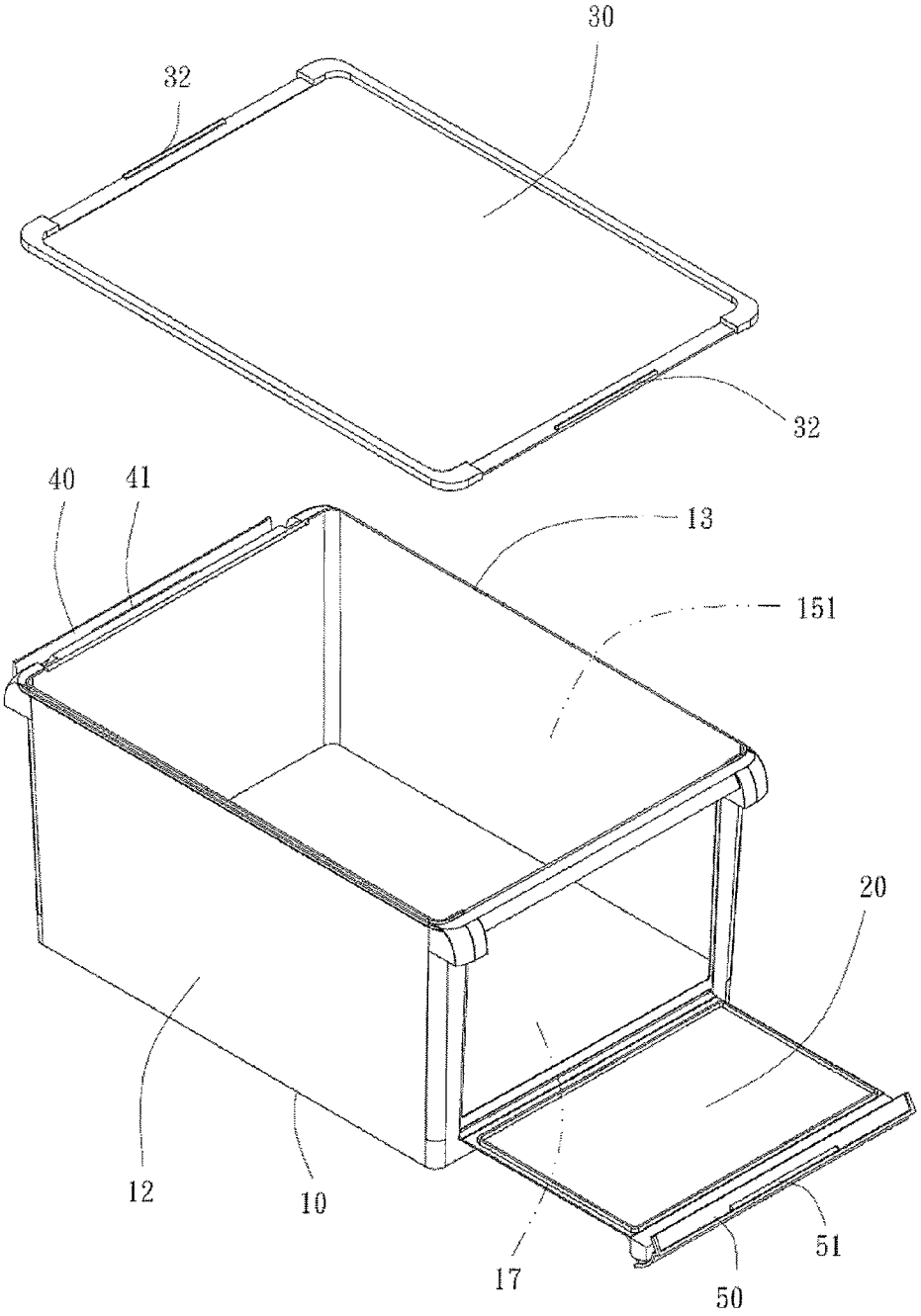
FIG. 6 is a schematic perspective view of the versatile storage bin structure with an upper lid opened upward and the right lateral lid opened downward according to an embodiment of the present invention.

Referring to FIG. 6, regarding the versatile storage bin structure, concave portions 41, 51 are disposed on engagement surfaces of the first and second fasteners 40, 50, respectively, whereas a raised portion 32 corresponding in position to each of the concave portions 41, 51 of the first and second fasteners 40, 50 is disposed on the upper lid 30 to thereby allow the concave portions 41, 51 to engage with and press against the raised portions 32 as soon as the first and second fasteners 40, 50 engage with and press against the upper lid 30.

Figure 8:
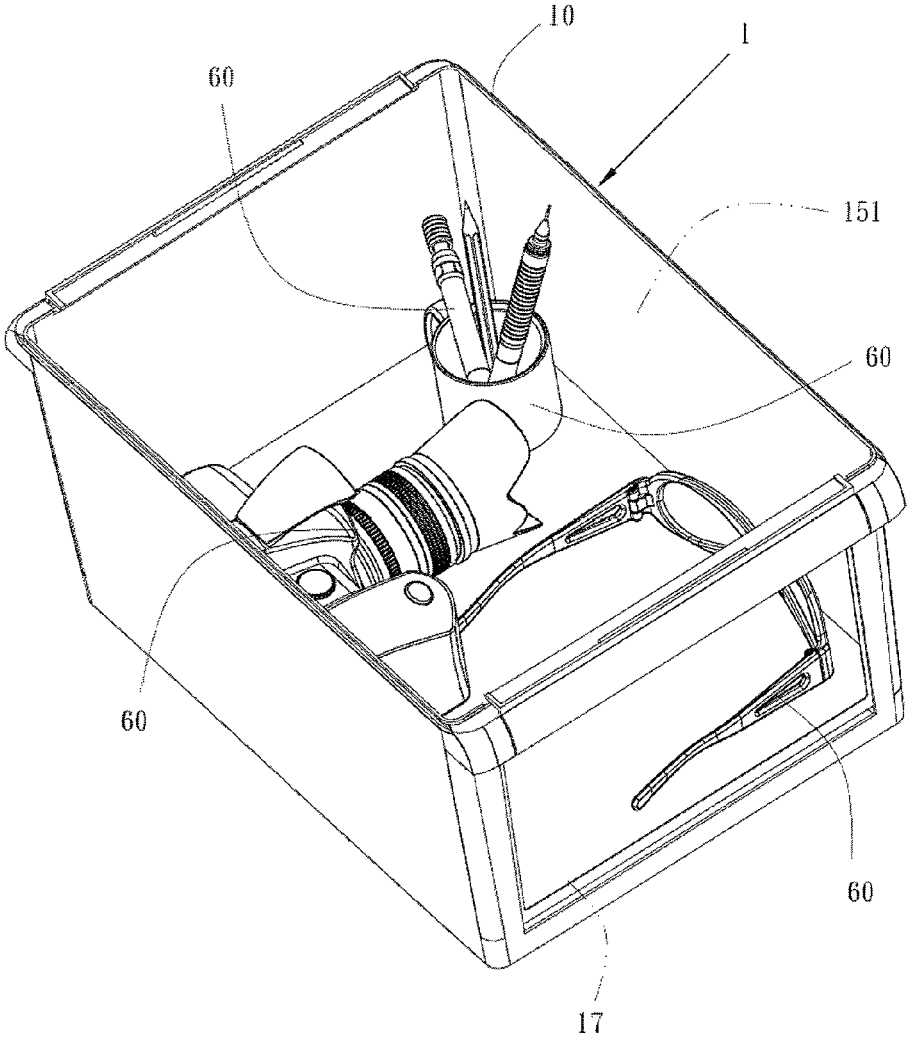
FIG. 8 is a schematic perspective view of the versatile storage bin structure which contains articles according to the present invention.

Referring to FIG. 8, the present invention provides a versatile storage bin structure characterized advantageously by the ease of use typical of conventional storage boxes in terms of article storage as well as the ease of use typical of conventional stack cabinets in terms of stacking. Hence, articles 60, such as a pen holder, a camera, a pen, and eyeglasses, disposed in the receiving space 15 of the storage bin body 10 are arranged in the direction of the upper opening 151 and in the sequence of frequent use or infrequent use. Specifically, articles in frequent use are positioned proximate to the lateral opening 17 of the storage bin body 10 to be quickly accessible from the lateral openings 17 when multiple storage bins 1 are stacked up.

Referring to FIG. 1, a male engaging element 221 is disposed on the top side of the right lateral lid 20, whereas the storage bin body 10 has a female engaging slot 191 corresponding in position to the male engaging element 221 of the right lateral lid 20. After the right lateral lid 20 has covered the lateral opening 17 of the storage bin body 10, the male engaging element 221 is engaged with and thus fastened to the female engaging slot 191 of the storage bin body 10 to not only fix the right lateral lid 20 in place but also allow the right lateral lids 20 to be smoothly opened or shut even when the storage bin bodies 10 are stacked up (as shown in FIG. 7).

Figure 7:
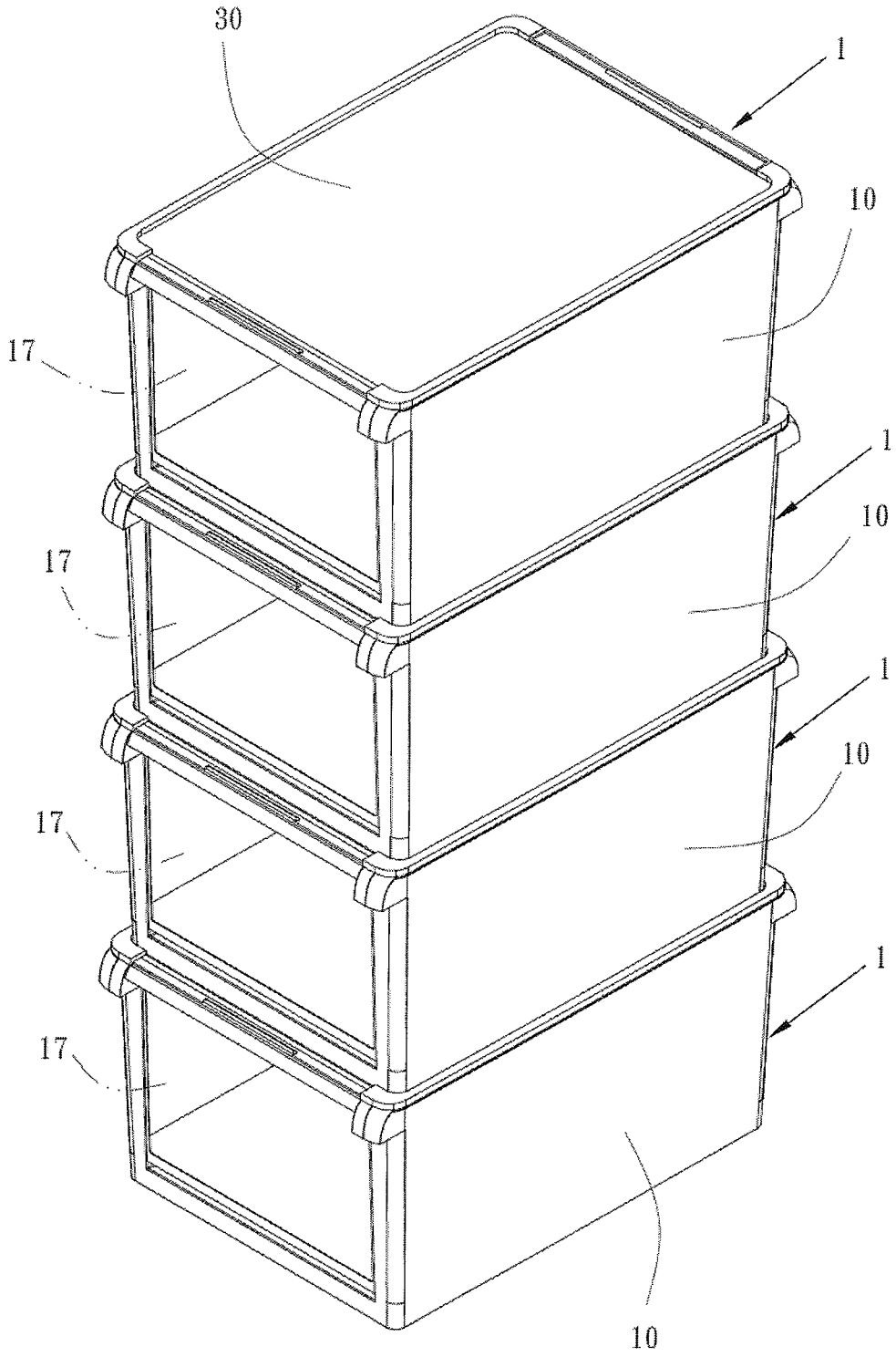
FIG. 7 is a schematic perspective view of the versatile storage bin structures stacked up in a cabinet-like manner and are for use accordingly according to the present invention.

Therefore, versatile storage bin structures of the present invention can be stacked up to serve either as a storage bin (as shown in FIG. 7) or as a storage box to manifest the ease of use in taking/placing articles as well as the ease of use taking/placing articles when the versatile storage bin structures are stacked up.

Accordingly, the versatile storage bin structure of the present invention comprises a storage bin body with upper and lateral openings coverable by an upper lid and a right lateral lid, respectively. The right lateral lid can be opened downward to retreat into the bottom of the storage bin body and thus allow articles to be taken from or put in storage bins from above or from the side thereof conveniently.

What is claimed is:

1. A versatile storage bin structure, comprising: a storage bin body having a bottom face, a front lateral face, a rear lateral face, and a left lateral face, wherein the bottom face, the front lateral face, the rear lateral face, and the left lateral face together define and enclose a receiving space having an upper opening, wherein a periphery of the bottom face extends downward to form a flange running along the periphery fully and defining a bottom space opening downward, with the storage bin body further comprising a right lateral lid, wherein the storage bin body is provided with a lateral opening coverable precisely by the right lateral lid, wherein a long groove is disposed at a portion of the flange of the storage bin body, communicates with the bottom space, and extends in a direction of the bottom space to form two rail grooves disposed on the bottom face of the storage bin body, wherein a distance between the two rail grooves is slightly larger than a length of the long groove, wherein two tenons are disposed protrudingly at two ends of a bottom edge of the right lateral lid, respectively, wherein a width of the right lateral lid equals a length of the long groove, wherein the two tenons are inserted, confined and enclosed by the two rail grooves in the long groove, respectively, wherein with the two tenons each functioning as an axis, the right lateral lid by which the lateral opening is coverable is rotated about the two tenons to be opened or shut, wherein when opened to lie horizontally, the two tenons slide relative to the two rail grooves, respectively, such that the right lateral lid retreats into the bottom space of the storage bin body, wherein a raised portion wider than the long groove and the right lateral lid is disposed at a top portion of the right lateral lid, with the raised portion abutting with the right portion of the flange outside the long groove to restrict a limit of retreat of the right lateral lid, wherein a projecting edge portion is disposed at an upper edge of the lateral opening of the storage bin body, wherein the right lateral lid covers the lateral opening fully and allows the raised portion to come close to the projecting edge portion, wherein a male engaging element is disposed on the raised portion, wherein a female engaging slot corresponding in position to the male engaging element is disposed on the projecting edge portion, wherein when the lateral opening is covered with the right lateral lid, the male engaging element is engaged with and thus fastened to the female engaging slot.

2. The versatile storage bin structure of claim 1, wherein the male engaging element of the raised portion of the right lateral lid comes in form of a rib or a plurality of round bumps, whereas the female engaging slot of the storage bin body, which corresponds in position to the rib or the plurality of round bumps of the right lateral lid, has a recess, with the lateral opening of the storage bin body covered with the right lateral lid, the rib or the plurality of round bumps is engaged with and thus fastened to the recess of the storage bin body to not only allow the right lateral lid to be fixed in place but also allow the right lateral lids to be smoothly opened or shut even when storage bin bodies are stacked up.

3. The versatile storage bin structure of claim 1, wherein the storage bin body further comprises an upper lid for covering the upper opening of the storage bin body precisely.

4. The versatile storage bin structure of claim 3, wherein the right lateral lid further comprises a fastener pivotally mounted at the raised portion at the top portion of the right lateral lid, and wherein when rotated and lifted, the fastener engages with and presses against the upper lid and the storage bin body, the right lateral lid to thereby couple the storage bin body and the upper lid together.

5. The versatile storage bin structure of claim 4, wherein the storage bin body further comprises a further fastener disposed pivotally at a top portion of the left lateral face of the storage bin body, and wherein when rotated and lifted, the further fastener engages with and presses against the upper lid and the storage bin body to thereby couple the storage bin body and the upper lid together.

6. The versatile storage bin structure of claim 4, wherein a rib is disposed on a top side of the upper lid such that, when the storage bin bodies are stacked up, the rib not only fastens but also elevates the storage bin body above to allow the first and second fasteners to be smoothly disengaged or engaged.

7. The versatile storage bin structure of claim 6, wherein concave portions are disposed on engagement surfaces of the first and second fasteners, respectively, whereas a raised portion corresponding in position to each of the concave portions of the first and second fasteners is disposed on the upper lid to thereby allow the concave portions to engage with and press against the raised portions as soon as the first and second fasteners engage with and press against the upper lid.

* * * * *